US006253861B1

(12) United States Patent
Carmichael et al.

(10) Patent No.: US 6,253,861 B1
(45) Date of Patent: Jul. 3, 2001

(54) CIRCULATION TOOL

(75) Inventors: Mark Carmichael, Aboye; Paul Howlett, Cults, both of (GB)

(73) Assignee: Specialised Petroleum Services Limited, Aberdeenshire (GB)

( * ) Notice: Subject to any disclaimer, the term of this patent is extended or adjusted under 35 U.S.C. 154(b) by 0 days.

(21) Appl. No.: 09/258,174

(22) Filed: Feb. 25, 1999

(30) Foreign Application Priority Data

| | | |
|---|---|---|
| Feb. 25, 1998 | (GB) | 9803891 |
| Mar. 3, 1998 | (GB) | 9804338 |
| Mar. 21, 1998 | (GB) | 9805987 |
| Apr. 28, 1998 | (GB) | 9808919 |

(51) Int. Cl.[7] ..... E21B 34/06
(52) U.S. Cl. ..... 175/237; 175/317
(58) Field of Search ..... 175/237, 317, 175/318, 424; 166/312, 332.4, 72

(56) References Cited

U.S. PATENT DOCUMENTS

| | | | | |
|---|---|---|---|---|
| 4,074,779 | * | 2/1978 | Cheung et al. | 175/317 |
| 4,520,870 | | 6/1985 | Pringle | 166/317 |
| 4,574,894 | * | 3/1986 | Jadwin | 175/317 |
| 4,645,006 | * | 2/1987 | Tinsley | 175/237 |
| 4,889,199 | * | 12/1989 | Lee | 175/317 |
| 5,392,862 | * | 2/1995 | Swearingen | 166/312 |
| 5,564,500 | * | 10/1996 | Rogers et al. | 166/312 |

FOREIGN PATENT DOCUMENTS

| | | | |
|---|---|---|---|
| 2 315 508 | 7/1997 | (GB) | E21B/21/10 |
| 2 327 691 | 7/1997 | (GB) | E21B/34/10 |
| 2 327 445 | 7/1998 | (GB) | E21B/34/10 |

* cited by examiner

*Primary Examiner*—Thomas B. Will
*Assistant Examiner*—Meredith Petravick
(74) *Attorney, Agent, or Firm*—Woodard, Emhardt, Naughton, Moriarty & McNett

(57) ABSTRACT

A tool or sub for use in a well bore is adapted to manipulate the circulation path of fluid through a drill string or work string in which the tool is connected. The apparatus has a body member defining an axial flow path with one or more radial outlets that may be opened or closed by respective valve members in use.

15 Claims, 6 Drawing Sheets

CIRCULATION TOOL

BACKGROUND OF THE INVENTION

This invention relates to down hole drilling and or production apparatus and particularly relates to a circulation tool.

It is considered desirable in the art of drilling for oil or gas to be able to circulate drilling fluid at all material times down a drill string. The present invention recognises the need for a sub or tool connectable in a drill string or the like that may be used for maintaining and or reinstating circulation, notwithstanding the operation of other tools or processes.

For example, in our co-pending International Patent Application Number PCT/GB98/03795 there is described an inner string suspended from a drill pipe which prevents circulation. At the bottom of the drill string is a sub with a generally open port to enable circulation thereat.

It is an object of the present invention to provide a sub or tool of suitable design for use in such an application.

Similarly, a tool or sub for enabling or manipulating circulation may be required for use over a mud motor or the like.

A further object of the invention is to provide a tool having suitability for use in well-bore cleanup operations, including the cleaning of risers.

A yet further object of the present invention is to meet the aforementioned objections while providing for circulation via radial and axial outlets in a tool or sub.

BRIEF SUMMARY OF THE INVENTION

According to the present invention there is provided apparatus for use in a well bore, the apparatus comprising a body member connectable in or to a drill string and one or more valve members, the body member having a radial outlet associated with each valve member and an-axial bore providing passage for drilling fluid between an axial inlet and an axial outlet, and between the axial inlet and each radial outlet, wherein each valve member is moveable between a respective first position at which the associated radial outlet is in either one of an open or a closed state and a second position at which the associated radial outlet is an alternative closed or open state, and characterised in that the valve member allows for fluid flow through or at least partially through the axial bore when in either of the aforementioned positions.

Preferably each radial outlet may be associated with filtration means for preventing the ingression of particles or debris into the body member of the apparatus.

Each valve member may be locatable within the axial bore of the body member and preferably includes an axial passage in line with the axial bore of the body member.

Each valve member may be held in its respective first position by a pin or other mechanical means, the mechanical means becoming inoperable or fractured at a predetermined load or force. For example, one or more valve members may be held in its respective first position by one or more shear pins. Alternatively, hydraulic means may be employed to hold each valve member in the respective first position.

Preferably each valve member is adapted to co-operate with a respective actuating device for actuating movement of the valve member from the first position to the second position. Each valve member may comprise a ball seat and the actuating device may be, for example, a dropped ball suitable for landing on the ball seat, so as to temporarily block the axial passage through the apparatus and thereby enable an increase in fluid pressure capable of shearing the pin or other means for maintaining the valve member in the first position.

The valve member may be provided with a second inlet which communicates with the axial passage, wherein the second inlet is obturated when the valve member is in the first position and open when the valve member is in the second position such that when the valve member is in the second position a circulation path through the apparatus and, more precisely, between the axial inlet and axial outlet of the body member, is maintained.

Also according to the present invention there is provided a down hole tool or sub comprising a body member having an inlet and a first and second outlet, the first outlet being generally located below or beyond the second outlet when the tool is run, and means for controllably closing the second outlet while maintaining a circulation path between the inlet and the first outlet.

Typically, the down hole tool or sub is a well cleanup tool. The tool may be suitable for use in a well riser. The tool or sub may be a fill up tool run above a mud motor or the like.

The body member may be attachable to a work string or the like. A rotatable sleeve may be mounted on the outside of the body member having jet outlets aligned with the radial outlets on the body member, wherein also at least some of the jet outlets are directed tangentially so that the reaction forces of fluid expelled from the one or more tangential jet outlets create a turning moment sufficient to cause rotation of the sleeve relative to the body member. Preferably, some of the jet outlets on the sleeve are orientated radially.

BRIEF DESCRIPTION OF THE DRAWINGS

In order to provide a better understanding of the invention, embodiments thereof will now be described by way of example only, and with reference to the accompanying Figures, in which.

DETAILED DESCRIPTION OF THE DRAWINGS

Figure 1:
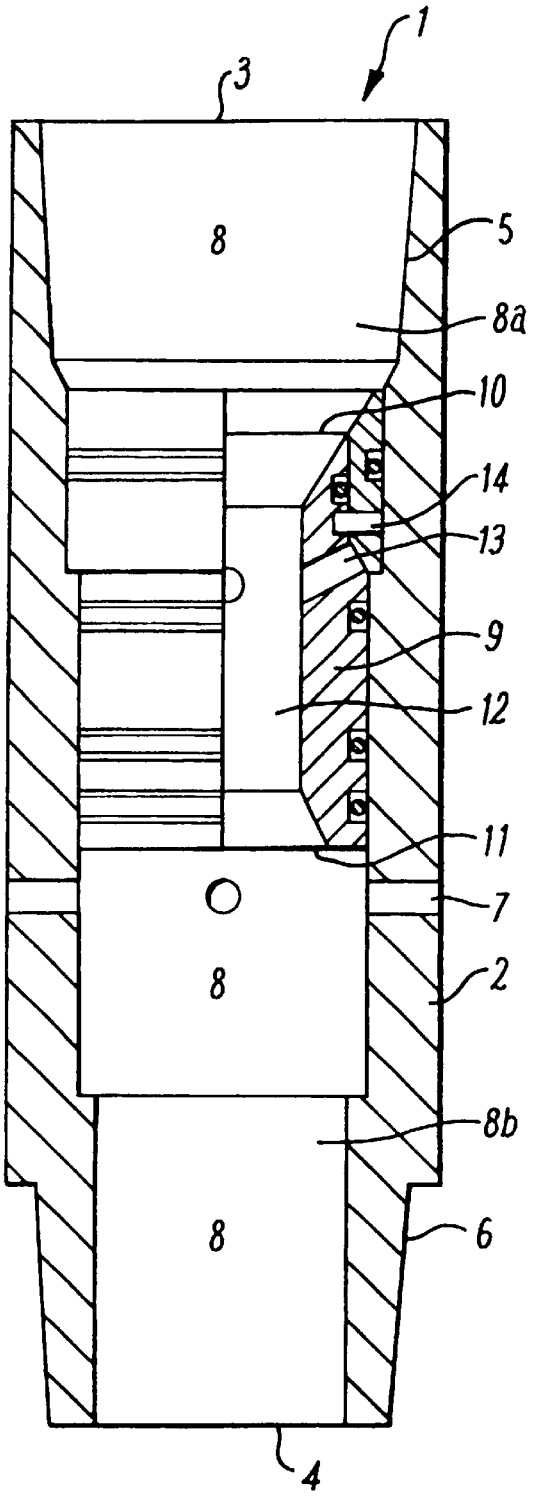
FIG. 1 shows a tool in one state of operation in accordance with the invention.
Figure 2:
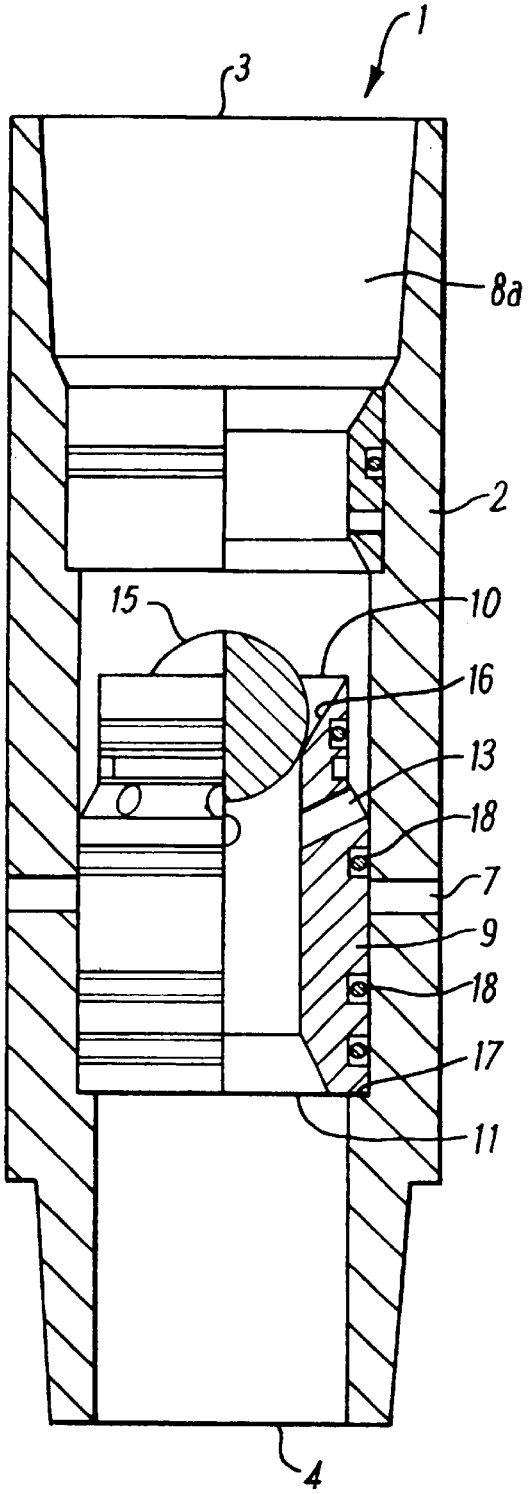
FIG. 2 illustrates the tool of FIG. 1, but in an alternative state of operation.

Referring firstly to FIGS. 1 and 2, two representations of a tool, generally described at 1, are depicted. The tool 1 is comprised of an elongated body member 2 having an axial inlet 3 and a first outlet 4. The first outlet 4 is axially aligned with the inlet 3.

The body member 2 is provided with attachment means 5,6 for connection of the tool 1 in a drill string (not shown).

A second or radial outlet 7 is provided in the body member 2 in the form of a plurality of radially disposed apertures. Nozzles may be located in the apertures of the second or radial outlet 7 to improve the cleaning efficiency of fluid expelled from the second outlet 7 in a well cleanup tool.

An axial bore 8 is formed through the body member 2. In the bore 8 is a valve member, generally depicted at 9. The valve member 9 also has an inlet 10 and an outlet 11, there being an axial passage 12 between the inlet 10 and outlet 11.

In FIG. 1 the valve member 9 is positioned in what is referred to herein as the first position. When in the first position, fluid may circulate through the tool 1 by entering the inlet 3, passing through the bore 8*a,* entering the valve inlet 10, passing through the passage 12, exiting the valve outlet 11 and re-entering the bore 8*b,* and finally exiting either the first outlet 4 or the second or radial outlet 7. Usually, the fluid will generally exit the second outlet 7 because of the pressure drop across this outlet.

Typically the second outlet 7 is formed as a plurality of jet ports for cleaning the inside walls of casings, risers or the like.

The valve member 9 includes a second inlet 13. The second inlet 13 is formed as a plurality of circumferentially spaced apertures. The second inlet 13 is closed or obturated when the valve member 9 is in the first position.

A shear pin 14 is used to hold the valve member 9 in the first position.

The valve member 9 may be moved to a second position as shown in FIG. 2. In the example embodiment shown, this is achieved by dropping a ball 15 from the surface until it nests on the ball rest 16. When the ball 15 is located on the rest 16, fluid flow is temporarily prevented through the tool 1 for so long as the valve member 9 remains in the first position. This allows fluid pressure to be built up above the ball 15 until the force on the ball 15 and valve member 9 is sufficient to shear the pin 14. Once this occurs, the valve member 9 moves down or along the body member 2 until it is stopped by the shoulder 17. The valve member 9 is then at what is generally referred to herein as the second position.

When the valve member 9 is in the second position, the second inlet 13 is open and able to receive fluid from the bore 8*a,* thereby reinstating a circulation path through the tool 1. However, the valve member 9, when in the second position as shown in FIG. 2, obturates the second outlet 7 in the body member 2, such that the fluid may only exit from the tool 1 at the first outlet 4.

Seals 18 are provided on the valve member 9 to improve the integrity of the closing of the second outlet 7 when the valve member 9 is in the second position.

With the valve member 9 in the second position, the tool 1 does not prevent an operator from pressuring up below or beyond the tool 1 in the drill string. This means that a more remote tool may be actuated or manipulated.

When the tool 1 is used in the cleaning of well risers it may be desirable to release the ball 15 from the seat 16 by pressuring up from beneath the tool 1.

Figure 3:
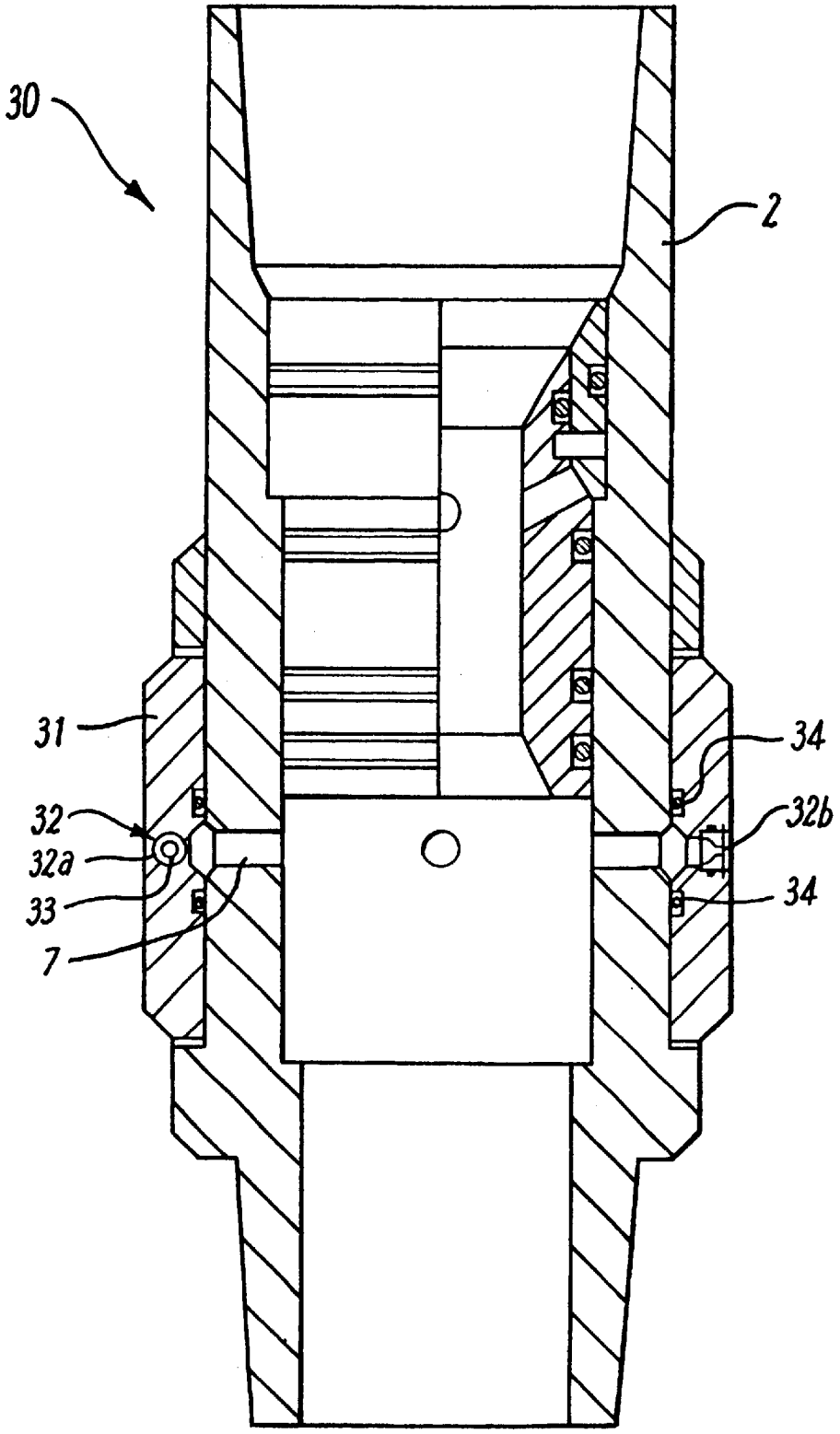
FIG. 3 shows an alternative tool in the same state of operation as the tool shown in FIG. 1.

The tool, generally depicted at 30 in FIG. 3, is similar to the tool shown in FIGS. 1 and 2, but has an additional sleeve 31 around the outer surface of the body member 2. The sleeve 31 has outlets 32 that are aligned with the apertures of the second outlet 7 on the body member 2. In the sleeve outlets 32 are provided nozzles 33 adapted to expel the fluid from the outlets 32 in a jet-like manner.

Seals 34 are provided between the sleeve 31 and the body member 2. The seals 34 are required because the sleeve 31 is rotatable on the body 2.

Notably, the outlet 32*a* is directed to expel the fluid tangentially, while the outlet 32*b* is directed to expel the fluid radially. The reaction forces from the tangentially directed jet or jets drive the relative rotation of the sleeve 31 around the body 2. As the sleeve rotates, it ensures a full 360 degree coverage of the cleaning jet expelled particularly from the radially directed nozzles.

Thus it may be seen that the addition of the sleeve member 31 further serves to improve the cleaning efficiency of the expelled circulating fluid in a clean up operation or the like.

It is realised herein that a tool in accordance with the present invention may be used for a diverse range of operations and applications, the tool having excellent versatility and utility.

This is demonstrated by the sub illustrated in FIG. 4, which is a fill up tool. The sub 40 is a more sophisticated form of the invention, having two valve members. The first valve member 9 is similar in construction and function to the valve members described above. However, the tool 40 includes a second valve member 41.

Figure 4A:
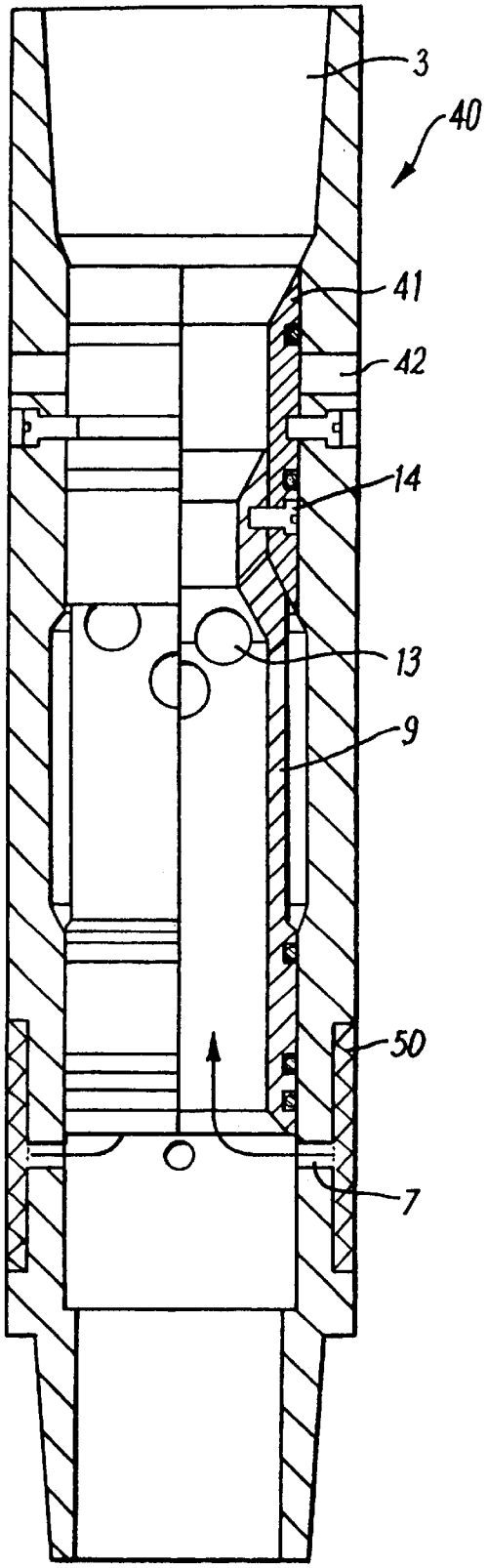
FIGS. 4*a,* 4*b* and 4*c* illustrate a drill pipe fill up tool in three alternative states of operation.
Figure 4B:
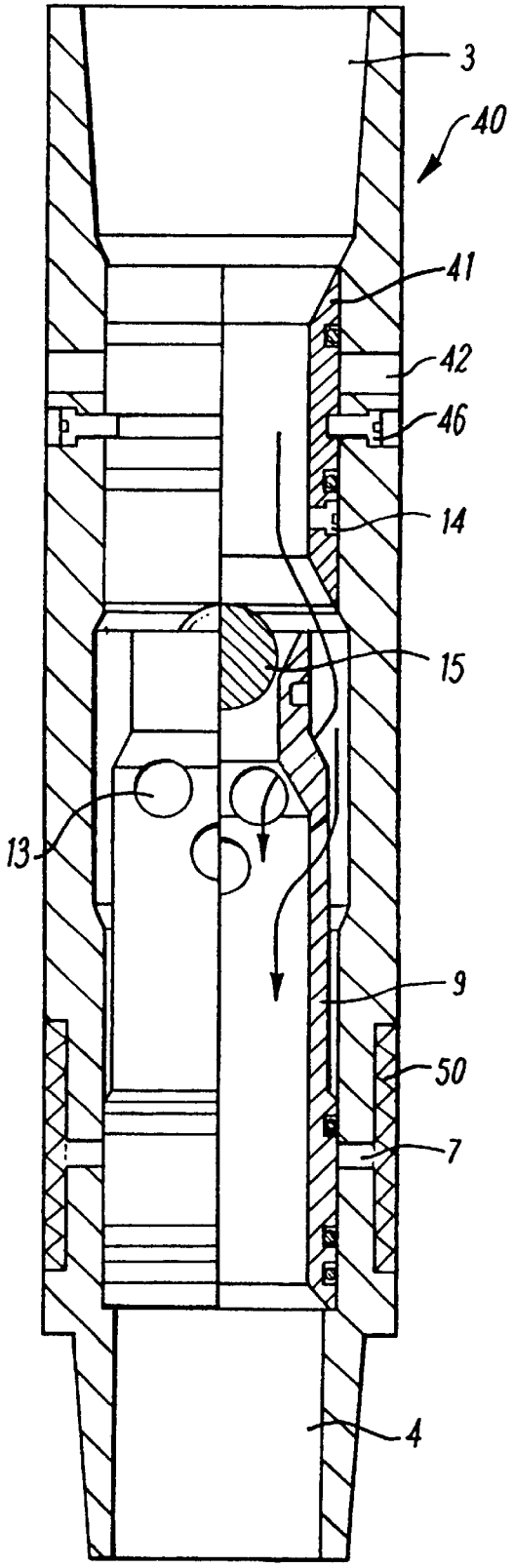
Figure 4C:
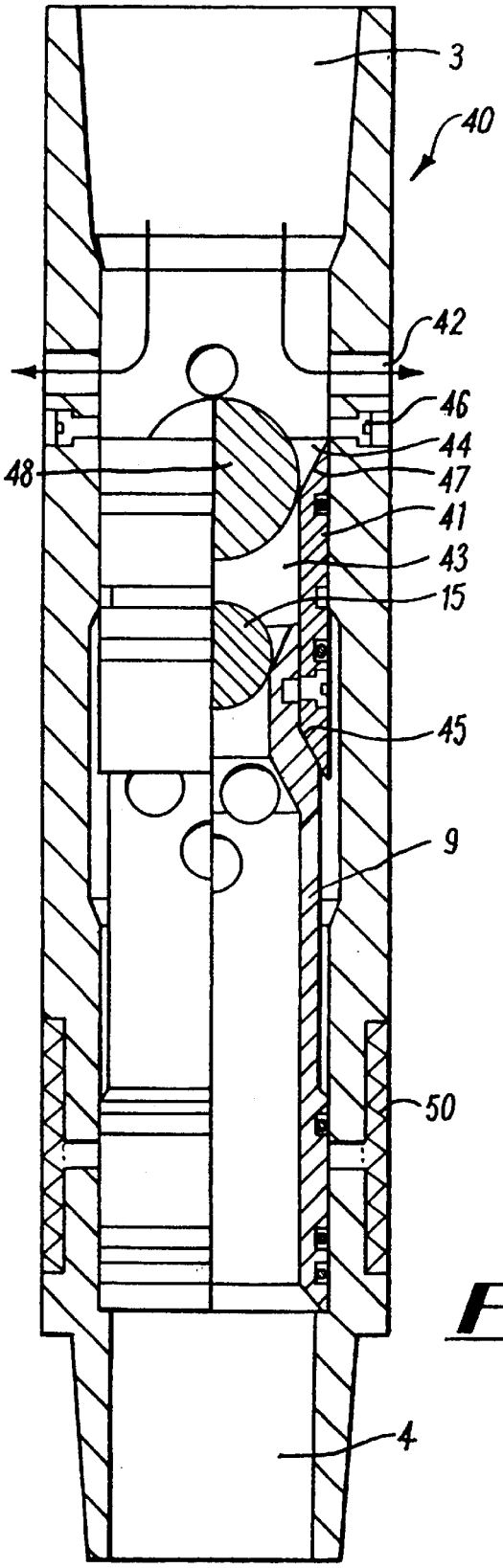

The second valve 41 is also moveable between a first position (as shown in FIGS. 4*a* and 4*b*) and a second position (as shown in FIG. 4*c*).

The second valve member 41 is associated with a respective second or radial outlet 42, while as before, the first valve is associated with a respective radial outlet 7. When the second valve member 41 is in the first position the respective radial outlet 42 is closed or obturated, while when the second valve member 41 is in the second position the respective radial outlet 42 is open.

The second valve member also has an axial bore 43 with an inlet 44 and an axial outlet 45. The second valve 41 is held in the first position by a shear pin 46. A ball rest 47 is located in the vicinity of the second valve inlet 44 for landing a ball 48, thereby allowing an operator to pressure up behind the ball 48 until the pin 46 shears and the second valve moves from the first position to the second position.

The sub 40 may be operated as follows. When the tool 40 is run, the valves 9 and 41 are located in their respective first position as shown in FIG. 4*a*. Unlike previous methods where a sub must be pre-filled prior to running, the sub or tool 40 is adapted to fill with drilling fluid while being run. As the drill string of which the tool 40 forms part is lowered into the well bore, fluid enters the tool 40 through the outlet (acting as an inlet) 7 and fills the tool 40. Wire screen filters 50 are placed around the outlets 7 to prevent the ingress of debris or other matter that might impede fluid circulation through the sub. The wire coils of the filter 50 may be adjusted to control the degree of filtration or permeability.

If required, fluid may then be circulated through the inlet 3, via the bores through the valve members 9,41 and out the outlet 7.

Thereafter, when the tool 40 is positioned and drilling is to commence, a first actuating device such as the ball 15 is dropped onto the rest 16. This allows pressuring up behind the ball sufficient to shear the pin 14 and allow the first valve 9 to move from the first position to the second position. As previously described, circulation is then re-established axially through the tool 40 via the axial inlet 3 and the axial outlet 4. The radial outlet 7 is obturated by the first valve member 9.

Prior to pulling out the tool 40, a second actuating member may be dropped, such as the ball 48 and landed on the rest 47. This temporarily prevents circulation through the tool 40 and allows for pressuring up behind the ball 48 until the shear pin 46 is sheared. The second valve 41 then moves from its first position to its second position leaving the associated radial outlet 42 in an open state. With the outlet 42 open, the tool 40 is able to empty of fluid as the tool 40 is pulled out of the well.

By way of example only, the ball 15 may be 38 millimeters diameter and the second ball 48 may be 56 millimeters diameter. The rests 16 and 47 would be sized accordingly.

It should be noted that with the example design of tool depicted in FIG. 4 the by-pass area around the valve 9 and through the first valve inlet is at least as large as the cross sectional area of the bore 49 through the second valve 41.

Figure 5:
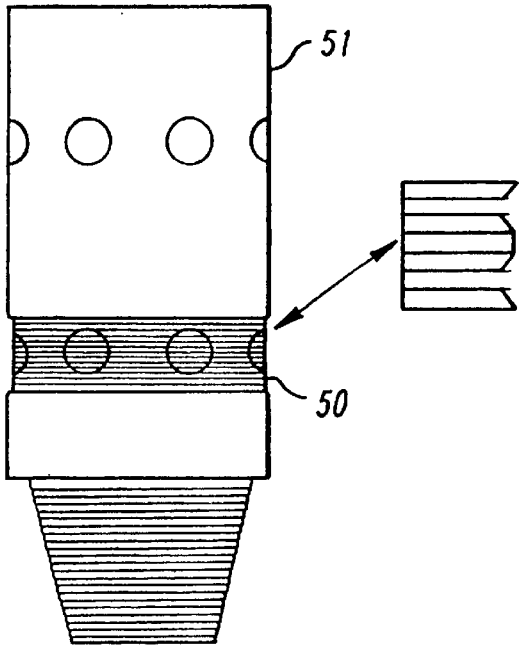
FIG. 5 illustrates an external view of the tool of FIG. 4 showing a filter over the outlets.

An external view of a tool 51 showing the filter 50 in place is illustrated in FIG. 5.

Reconfiguration of the above-described tools would make it possible for the valves to close or open respective or associated outlets in an alternative manner to that described. For example, in an alternative embodiment the first valve could allow an associated radial outlet to be closed when the valve was in the first position and then open when the valve was in the second position. This alternative arrangement of the sub is illustrated in FIGS. 6*a,* 6*b* and 6*c.*

Figure 6A:
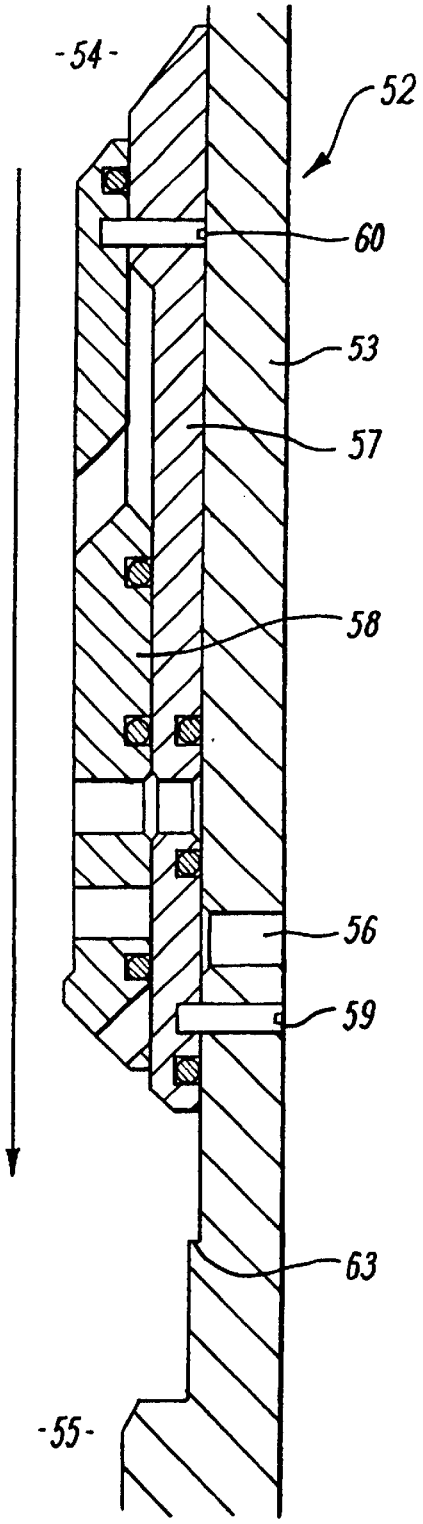
FIGS. 6*a,* 6*b* and 6*c* illustrate one half of an alternative tool whose operation is the inverse of the tool illustrated in FIG. 4.

The tool, generally depicted at 52 in FIGS. 6*a,* 6*b* and 6*c,* is shown in sectional elevation. The tool 52 is comprised of an elongated body member 53 having an axial inlet 54 and a first outlet 55. The first outlet 55 is axially aligned with the inlet 54.

The body member 53 is provided with attachment means (not shown) for connection of the tool 52 in a drill string (not shown). A second or radial outlet 56 is provided in the body member 56 in the form of a plurality of radially disposed apertures. Nozzles may be included in the apertures of the second or radial outlet 56 to improve the cleaning efficiency of the fluid expelled from the second outlet 56 in a well cleanup tool.

Figure 6B:
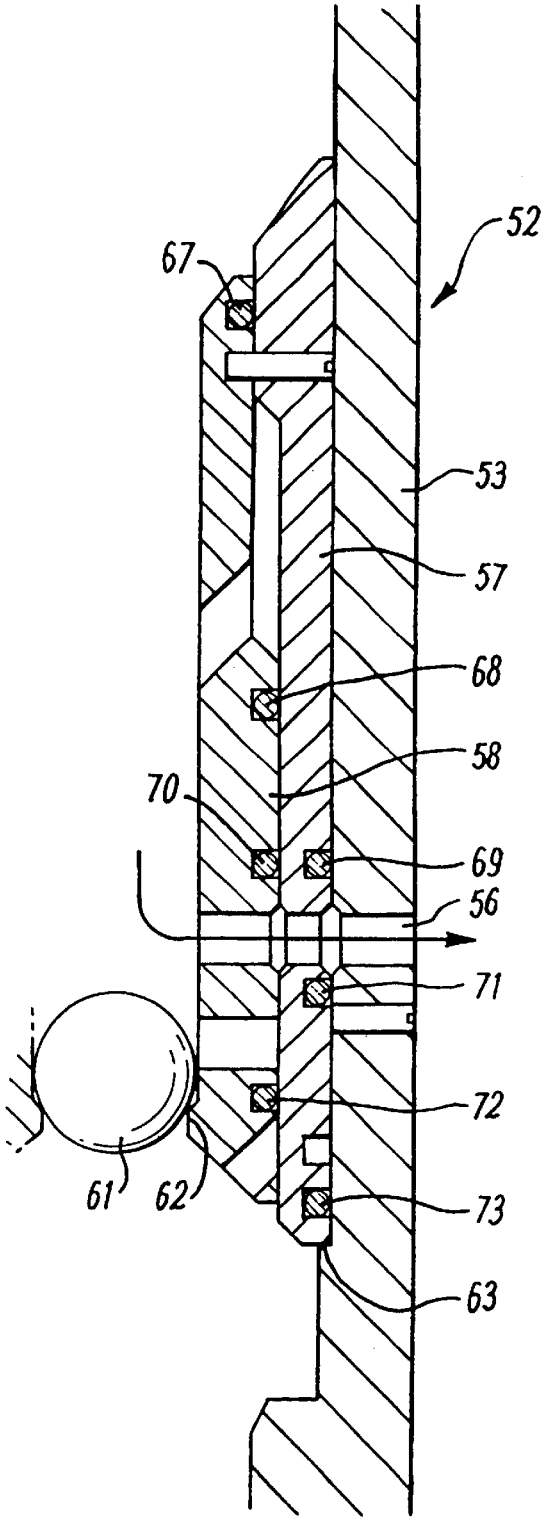
Figure 6C:
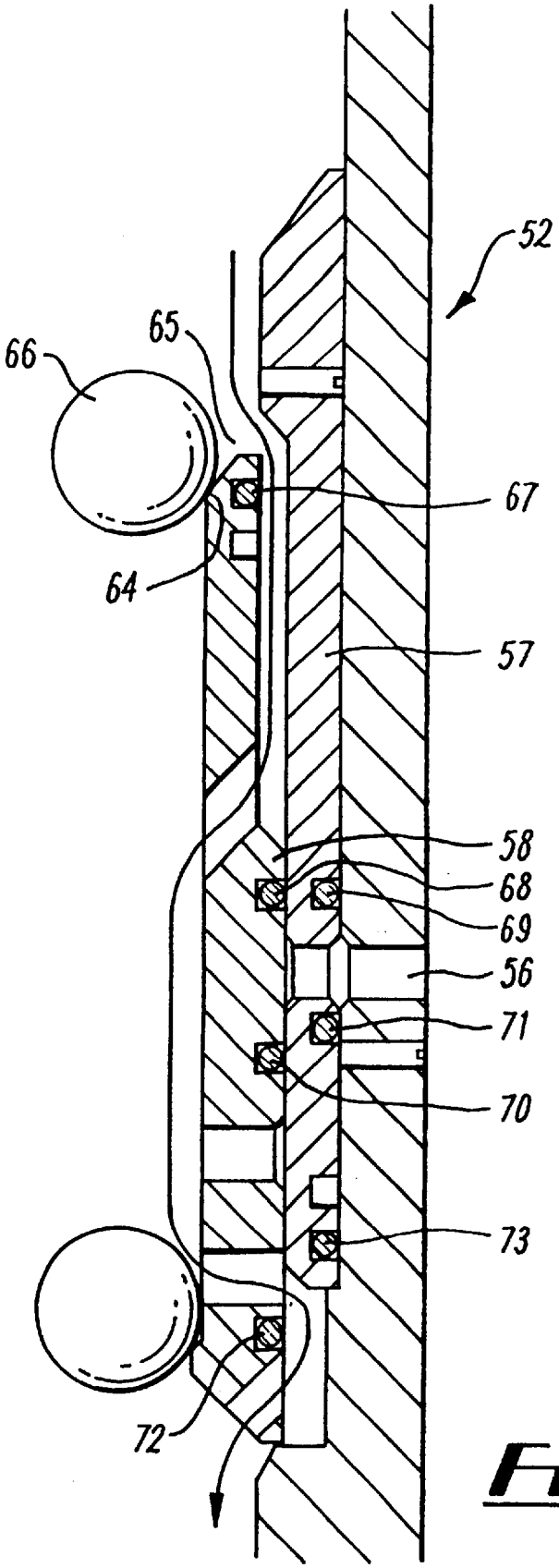

The first valve member 57 is capable of moving between a first position as shown in FIG. 6*a* and a second position as shown in FIG. 6*b*. The second valve member 58 is also capable of moving between a first position relative to the first valve member 57 as shown in FIG. 6*b* and a second position as shown in FIG. 6*c*.

Both the first and second valve members 57 and 58 are held in position by shear pins; the first valve member 57 being held in position by shear pin 59 and the second valve member 58 by shear pin 60. Shearing of pin 59 results in the simultaneous movement of the first valve member 57 and the second valve member 58.

The first valve member 57 is associated with a respective second or radial outlet 56. When the first valve member 57 is in the first position the respective radial outlet 56 is closed or obturated, while in the second position the respective radial outlet 56 is open. When the second valve member 58 is in the first position the radial outlet 56 is open, while in the second position the radial outlet 56 is closed.

The first valve member 57 may be moved from the first position to the second position as shown in FIG. 6*b*. In the example embodiment shown, this is achieved by dropping a ball 61 from the surface until its nests on the ball rest 62. When the ball 61 is located on the rest 62, fluid flow is temporarily prevented through the tool 52 for so long as the first valve member 57 remains in the first position. This allows fluid pressure to be built above the ball 61 until the force on the ball 61 and the first valve member 57 is sufficient to shear the pin 59. Once this occurs, the first valve member 57 and the second valve member 58 move down or along the body member 53 until they are stopped by the shoulder 63. The first valve member 57 is now at the second position. When the first valve member 57 is in the second position the outlet 56 is open as shown in FIG. 6*b*.

The second valve member 58 is held in position by a shear pin 60. A ball rest 64 is located in the vicinity of the second valve inlet 65 for landing a ball 66, thereby allowing an operator to pressure up behind the ball 66 until the pin 60 shears and the second valve moves from the first position to the second position. The movement of the second valve member 58 results in the closure of the outlet 56 and re-establishes circulation through the tool.

Seals 67–73 are included to improve the integrity of the valves and the circulation of the tool.

Further modifications and improvements may be incorporated without departing from the scope of the invention herein intended.

What is claimed is:

1. Apparatus for use in a well bore comprising a body member connectable in or to a drill string and one or more valve members, the body member having a radial outlet associated with each valve member and an axial bore providing passage for drilling fluid between an axial inlet and an axial outlet, and between the axial inlet and each radial outlet, wherein each valve member is moveable between a respective first position at which the associated radial outlet is in either one of an open or a closed state and a second position at which the associated radial outlet is an alternative closed or open state, and characterised in that the valve member allows for fluid flow through or at least partially through the axial bore when in either of the aforementioned positions.

2. Apparatus as claimed in claim 1 wherein each radial outlet is associated with filtration means for preventing the ingression of particles or debris into the body member of the apparatus.

3. Apparatus as claimed in claim 1 wherein each valve member is locatable within the axial bore of the body member.

4. Apparatus as claimed in claim 3 wherein each valve member includes an axial passage in line with the axial bore of the body member.

5. Apparatus as claimed in claim 1 wherein one or more of the valve members is held in its respective first position by a shearing pin, the shearing pin becoming inoperable or fractured at a predetermined load or force.

6. Apparatus as claimed in claim 1 wherein each valve member is adapted to co-operate with a respective actuating device for actuating movement of the valve member from the first position to the second position.

7. Apparatus as claimed in claim 6 wherein at least one of the valve members comprises a ball seat and the actuating device includes a dropped ball suitable for landing on the ball seat, so as to temporarily block the axial passage through the apparatus and thereby enable an increase in fluid pressure capable of shearing the shearing pin for maintaining the valve member in a first position.

8. Apparatus as claimed in claim 1 wherein at least one of the valve members is provided with a second inlet which communicates with the axial passage, wherein the second inlet is obturated when the valve member is in the first position and open when the valve member is in the second position such that when the valve member is in the second position a circulation path between the axial inlet and axial outlet of the body member, is maintained.

9. A down hole tool or sub comprising a body member having an inlet and first and second outlets, the first outlet being generally located below or beyond the second outlet when the tool is run, and means for controllably closing the second outlet while maintaining a circulation path between the inlet and the first outlet.

10. A down hole tool or sub as claimed in claim 9, being a well cleanup tool.

11. A down hole tool or sub as claimed in claim 9, being a fill up tool suitable for running above a mud motor.

12. Apparatus for use in a well bore comprising a body member connectable in or to a drill string and one or more valve members, the body member having a radial outlet associated with each valve member and an axial bore providing passage for drilling fluid between an axial inlet and an axial outlet, and between the axial inlet and each radial outlet, wherein each valve member is moveable between a respective first position at which the associated radial outlet is in either one of an open or a closed state and a second position at which the associated radial outlet is an alternative closed or open state, wherein the valve member allows for fluid flow through or at least partially through the axial bore when in either of the aforementioned positions, and characterised in that a rotatable sleeve is mounted on the outside of the body member, the sleeve comprising jet outlets aligned with the radial outlets on the body member, wherein also at least some of the jet outlets are directed tangentially so that the reaction forces of fluid expelled from the one or more tangential jet outlets create a turning moment sufficient to cause rotation of the sleeve relative to the body member.

13. Apparatus as claimed in claim 12 wherein at least some of the jet outlets on the sleeve are oriented radially.

14. A down hole tool or sub comprising a body member having an inlet and a first and second outlet, the first outlet being generally located below or beyond the second outlet when the tool is run, and means for controllably closing the second outlet while maintaining a circulation path between the inlet and the first outlet wherein a rotatable sleeve is mounted on the outside of the body member, the sleeve comprising jet outlets aligned with the radial outlets on the body member, wherein also at least some of the jet outlets are directed tangentially so that the reaction forces of fluid expelled from the one or more tangential jet outlets create a turning moment sufficient to cause rotation of the sleeve relative to the body member.

15. A down hole tool or sub as claimed in claim 14 wherein at least some of the jet outlets on the sleeve are orientated radially.

* * * * *